US005222989A

United States Patent [19]

Hyca

[11] Patent Number: 5,222,989

[45] Date of Patent: Jun. 29, 1993

[54] TAPE FEED-IN DEVICE ON A SEWING MACHINE

[75] Inventor: Bohumil Hyca, Stuttgart, Fed. Rep. of Germany

[73] Assignee: Union Special GmbH, Stuttgart, Fed. Rep. of Germany

[21] Appl. No.: 884,654

[22] Filed: May 14, 1992

[30] Foreign Application Priority Data

May 17, 1991 [DE] Fed. Rep. of Germany ..... 4116297

[51] Int. Cl.[5] ..... D05B 37/04; D05B 35/06

[52] U.S. Cl. ..... 112/121.27; 112/130; 112/152; 226/110

[58] Field of Search ..... 112/121.27, 152, 322, 112/121.26, 318, 130, 305, 306; 226/109, 110

[56] References Cited

U.S. PATENT DOCUMENTS

| | | | |
|---|---|---|---|
| 3,182,619 | 5/1965 | Sally | 112/153 X |
| 3,664,284 | 5/1972 | Hester | 112/152 |
| 3,792,672 | 2/1974 | Friedman et al. | 112/121.26 X |
| 4,044,698 | 8/1977 | Conner, Jr. | 112/121.26 X |
| 4,075,956 | 2/1978 | Manetti | 112/121.27 |
| 4,777,891 | 10/1988 | Hyca | 112/130 |
| 4,829,919 | 5/1989 | Fieschi | 112/152 |
| 4,892,047 | 1/1990 | Fieschi | 112/152 X |

*Primary Examiner*—Clifford D. Crowder
*Assistant Examiner*—Paul C. Lewis
*Attorney, Agent, or Firm*—Willian Brinks Olds Hofer Gilson & Lione

[57] ABSTRACT

A tape feeder for at least two tapes (8,11) which can be taken from a stock is arranged on a sewing machine. The tape feeder has a controlled feed-in device (12) which is arranged transversely to the workpiece feed direction (16), in such a way that it can move, and which has a motor driven shaft (13), which transports tape as desired to the presser foot (6) on the sewing machine. A cutting device (14) arranged on the feed device (12) enables the tapes to be cut off.

5 Claims, 2 Drawing Sheets

TAPE FEED-IN DEVICE ON A SEWING MACHINE

BACKGROUND OF THE INVENTION

The invention relates to a tape feeder for a sewing machine for feeding a selected one of two or more tapes to the machine presser foot.

A tape feeder with a feeder roller to feed in elastic tapes under the presser foot on a sewing machine is known from DE 38 30 772 Al which corresponds to the U.S. Pat. No. 4,829,919. This known feeder has a presser device with two presser support rollers which are held rotatably by a pivot plate and arranged in advance of and after feed roller. The presser support rollers can be operated by a change-over device in such a way that they affect the feed rollers individually and the feed roller is designed in such a way that it reverses its rotational direction if the other presser support roller becomes effective. By reason of the constructive embodiment, this device performs a motion relative to the sewing machine in the workpiece feed direction when the change-over device is operated. In so doing, the operator's field of vision of the point where the stitches are formed can be impaired and thus cause the operator to become prematurely fatigued.

An object of the invention is therefore to design a tape feeder such that the operator's field of vision is not impaired and that fatigue is kept as low as possible when operating the sewing machine.

SUMMARY OF THE INVENTION

The present invention resides in a tape feeder for at least two tapes which can be taken up from a stock on a sewing machine, having a work piece advancing device provided with a presser foot, a feed device arranged in such a way that its movements can be controlled and having a motor driven shaft, for feeding the pre-selectable tapes to the presser foot, and a cutting device for cutting-off the tapes which are to be attached to a work piece, the feed device being arranged for controllable movement transversely to the workpiece feed direction to a predetermined position in such a way that its movements can be controlled, so that in each case one of the tape can be allocated to the presser foot.

By shifting the feed device transversely to the workpiece feed direction from position A into position B and back, on the one hand, a tape feeder of a compact and simple construction is produced and on the other hand no substantial relative motion with regard to the operator so that the operator is not stressed when working on the sewing machine.

The fact that the tapes which can be non-stretch or elastic are pressed on next to each other and secured alternatly makes it possible to meter them and feed them up to the point where the stitches are formed or rather up to the presser foot on the sewing machine without reversing rotational direction of the shaft.

A cutting device can be associated directly with the tapes, i.e. it moves together with the feed device so that there is no additional requirement of space for a device to move the ripper. It is advantageous to provide lockable stops to limit the transverse movement of the feed device at the tape feeder. The stops enable the tapes to be attached to the workpiece to be finely adjusted laterally.

An example of a ripper is already described in detail in the German Patent DE 36 35 844 Cl and the U.S. Pat. No. 4,777,891.

BRIEF DESCRIPTION OF THE DRAWINGS

The present invention will be described further by way of example, with reference to the accompanying drawings, in which.

DETAILED DESCRIPTION OF PREFERRED EMBODIMENTS

Figure 1:
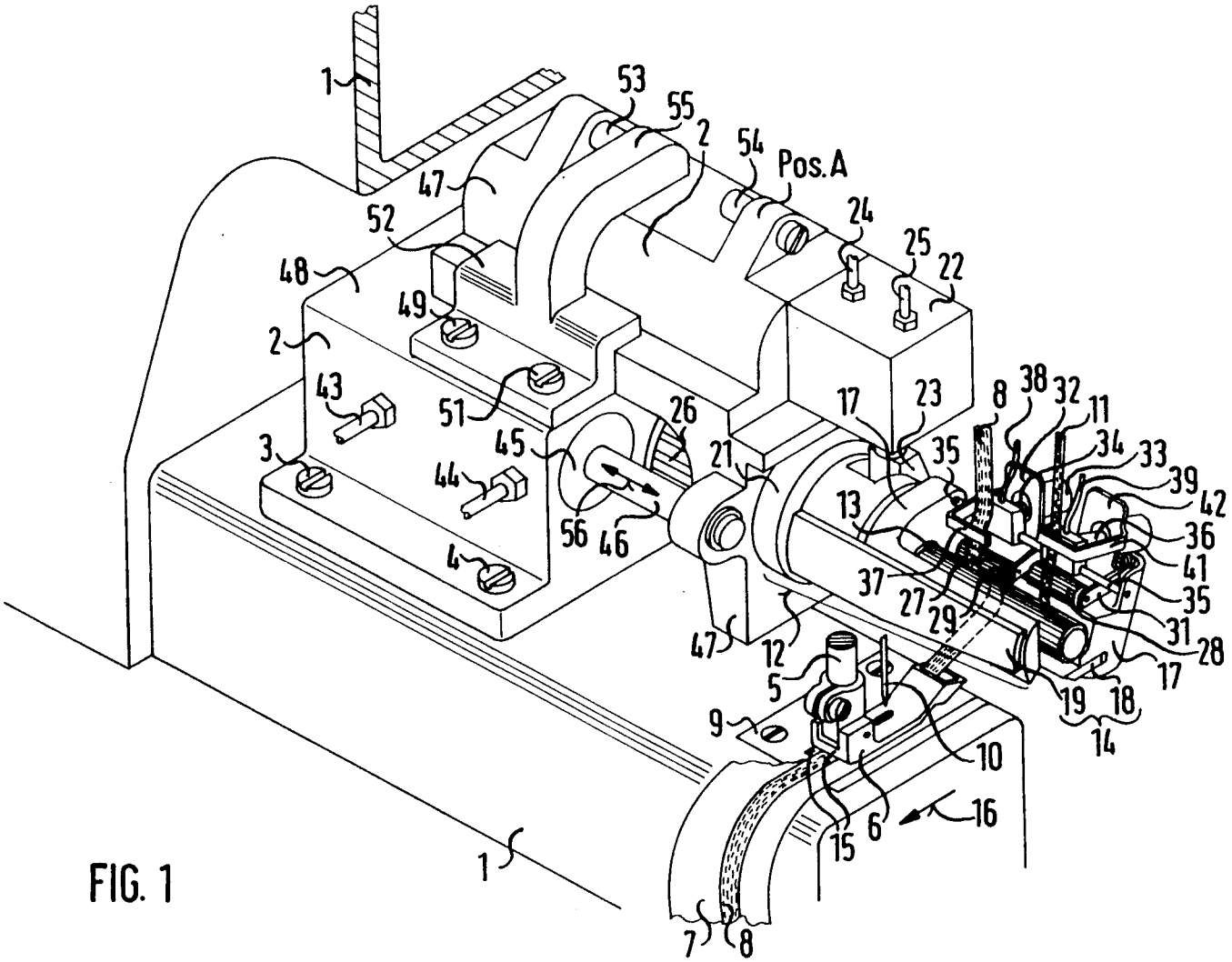
FIG. 1 is a perspective view, from behind, of a tape feeder in a sewing machine, illustrated fragmentarily, with a feed device in position A.

Referring to FIG. 1, a sewing machine has a housing 1 which carries a tape feeder 2 which is attached to the housing 1 with bolts 3 and 4. A presser foot 6 is attached to a presser rod 5 which projects into the housing 1 (shown broken away), with the presser foot 6 pushing a workpiece 7 and a tape 8 against a needle plate 9. A sewing needle 10 arranged in such a way that it can move up and down attaches the tape 8 to the workpiece 7.

Tape 8 and a further tape 11 are transported from a store, (not illustrated) which can even have further tapes, towards a controlled feed device 12 arranged, in such a way as to be able to move, transversely to the workpiece feed direction. The feed device 12 in FIG. 1 is located in Position A and has a motor driven shaft 13.

The feed device 12 supports a severing device 14 for cutting off the tapes 8 and 11 which are to be attached to the workpiece 7. The tapes can be nonelastic or elastic. A workpiece advancing device 15 transports the workpiece 7 and the tape 8 in the workpiece feed direction identified by an arrow 16.

The severing device 14 has a knife holder 17 arranged transversely to the workpiece feed direction in such a way that it moves backwards and forwards. The holder 17 supports a knife 18. A curved knife 19 is attached to an annular body 21.

The curved knife 19 is driven by a double-acting pressurized cylinder 22. A rod 23 shaped like the head of a fork and protruding out of the cylinder 22 is connected to and drives the annular body 21. The cylinder 22 is operated by a pressure medium, e.g. compressed air, which flows through pipe 24 and 25 respectively and is alternatively redirected by way of a valve (not illustrated). This causes the rod 23 to move up and down, swivelling the annular body 21 around the knife holder 17 and thus operating the curved knife 19, which moves against a knife 18 and in each case cuts off one of the tapes 8 or 11. Tapes 8 and 11 can also be cut off using further known cutting devices, where the knives move for example at an angle or substantially in a plane relative to each other.

The tapes 8, 11 are transported or rather advanced by means of the shaft 13, which is driven by a servo motor 26, e.g. a stepper motor. The servo motor 26 is controlled by a known control device (not illustrated), which drives the servo motor 26 at a rate corresponding to or independent from the speed of the sewing machine advancing the workpiece.

Opposite the shaft 13 there is a rotatably journalled presser roller 27 for tape 8 and a further presser roller 28 for tape 11. The presser roller 27 is mounted in a U-shaped holder 29 and presser roller 28 in a U-shaped holder 31. The holder 29 is part of an angled plate 32, which supports a hollow cylinder 33, into which protrudes an angled hollow rod 34.

The hollow rod 34 is pivotably journalled on an axle 35, which is rigidly connected to the knife holder 17 and supports a further pivotable hollow rod 36 which is operatively connected to the further presser roller 28.

Plate 32 supports an angled clamping element 37, which is arranged to open towards the hollow rod 34, in such a way that tape 8 can be freely transported up to the presser foot 6. Pressure medium pipes 38 and 39 respectively supply alternately the hollow rods 34 and 36 by way of a valve (not illustrated).

A further clamping device 41, which corresponds in its operating construction to the clamping device 37, is arranged on a plate 42. The clamping device 41 secures that tape 11 cut off by the cutting device 14, as the clamping device 41 is operated by way of the pressure medium pipe 39 and thus secures tape 11 between clamping device 41 and hollow rod 36. The tape feed device 2 has a double-acting cylinder 45 pressurised by means of the pressure medium pipes 43 and 44, a plunger 46 protrudes out of the cylinder 45 and moves a support 47, carrying the feed device 12, to and fro.

An angled linear guide bar 52 is attached to a cylinder body 48 by means of two bolts 49 and 51, the angled guide bar 52 guides the support 47 and thus the feed device in such a way that they move to and fro.

Lockable screw-threaded stops 53 and 54 respectively limit the transverse travel of the feed device 12. The stops 53 and 54 are adjustably positioned in the support 47 and work against a block 55, which limits the transverse travel. A double arrow 56 indicates the directions of travel of plunger 46 and thus the direction of travel of the support 47 and the feed device 12 from the Position A illustrated into Position B, which is produced by the stop 54 hitting against the block 55 and by changing the position of the presser rollers 27 and 28.

Figure 2:
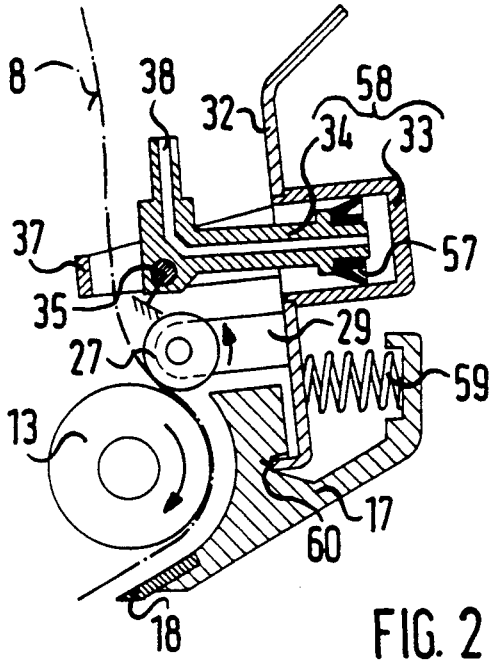
FIG. 2 is a fragmentary sectional view of the feed device, with its presser roller positioned in operative relationship with a shaft, a clamping device opened, and the feed device in position A.
Figure 3:
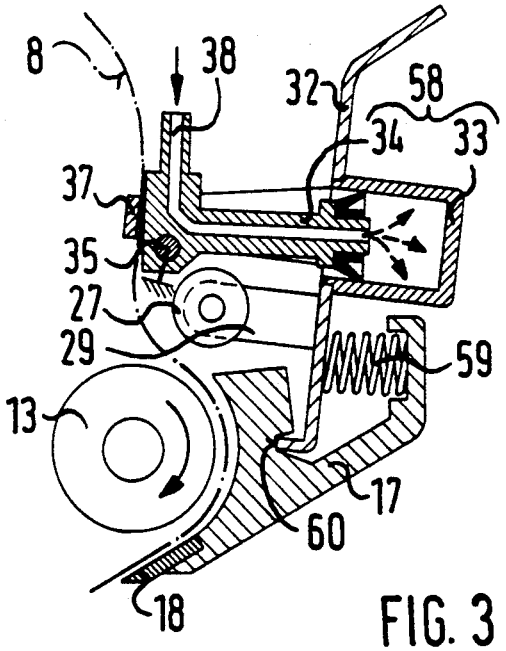
FIG. 3 is fragmentary sectional view of the feed device, with its presser roller positioned out of operative relationship to the shaft, the clamping device closed, and the feed device in position B.

FIGS. 2 and 3 show the function of the tape guide and further details of the feed device 12.

In FIG. 2, the hollow rod 34 supports on its free end a sealing collar 57 and forms together with the hollow cylinder 33 a cylinder drive 58 for moving the presser roller 27 and the clamping element 37. When the cylinder drive 58 is not pressurised, a spring 59 pushes the plate 32 with the presser roller 27 against the tape 8 and the shaft 13, as the plate 32 is pivotably journalled in a groove 60 of the knife holder 17. Arrows indicate the uniform direction of rotation of the shaft 13 and the feed direction of the tape 8.

In FIG. 3, the cylinder drive 58 is charged with a pressure medium. In this way the clamping element 37 clamps the tape 8 against the hollow stem 34 pivotably journalled around the axle 35. The presser roller 27 is positioned out of operative relationship with the shaft by the lateral pivoting movement of plate 32.

The two pivoting drives of the presser rollers 27 and 28 are of the same construction, i.e, the construction of the drive of the presser roller 28 corresponds to the construction of the drive with the cylinder drive 58 of the presser roller 27, which is represented in FIGS. 2 and 3.

The operation of the tape feeder is as follows:

In FIG. 1, the feed device 12 is located in Position A. In this way, tape 8 can be transported by means of the motor driven shaft 13 to the presser foot 6 or rather to the workpiece advancing device 15. In so doing, tape 11 is secured. If tape 11 is now to be transported, when the cutting device 14 is operated and tape 8 cut off. The cylinder 45 is then redirected to Position B by means of the pressure medium. At the same time, the plunger 46 moves in the cylinder 45 and the support 47 attached to the plunger 46 moves up to the cylinder body 48 until the stop 54 rests on the block 55. At the same time the supply of pressure medium of the two pivot drives of the presser rollers 27 and 28 is redirected and the tape 11 is pushed against the shaft 13 by means of the presser roller 28. Having been redirected, tape 8, as illustrated as position B in FIG. 3, is now secured by means of the clamping element 37 and tape 8 is free from shaft 13. It is now possible to operate the servo motor 26 again by way of the control device, the servo motor drives the shaft 13 and thus feeds tape 11 to the presser foot 6. This enables the feed and cutting of at least two tapes 8, 11 to be controlled as desired in a simple way on a sewing machine.

I claim:

1. A tape feeder in combination with a sewing machine for at least two preselectable tapes, which can be taken up from a store on the sewing machine said sewing machine having a support and a workpiece advancing device provided with a presser foot, the tape feeder comprising a feed device slidably mounted to said support on the sewing machine for controllable movement, transverse to a workpiece feed direction, to a predetermined position so that in each case one of the preselectable tapes can be allocated to the presser foot; a motor driven shaft rotatably connected at a proximal end to the feed device for feeding the preselectable tapes to the presser foot; and a severing device supported by the feed device for cutting-off the preselectable tapes which are to be attached to a workpiece.

2. A tape feeder in combination with a sewing machine as claimed in claim 1, in which the feed device has at least two presser rollers rotatably supported adjacent to each other, each of which is individually in operative association with the motor driven shaft.

3. A tape feeder in combination with a sewing machine as claimed in claim 2, in which a clamping device is located above each presser roller to secure each tape which is not in operative relationship with the motor driven shaft.

4. A tape feeder in combination with a sewing machine as claimed in claim 1, further comprising at least two lockable stops positioned on the slidably mounted feed device for limiting the transverse movement of the feed device.

5. A tape feeder in combination with a sewing machine for at least two preselectable tapes that can be taken up from a store on the sewing machine comprising a feed device slidably mounted to a support on the sewing machine, a motor driven shaft rotatably connected at a proximal end to the feed device, a severing device supported by the feed device for cutting off the preselectable tapes, and means for controlling the movement, to at least two predetermined positions, of the feed device in a direction transverse to a workpiece feed direction.

* * * * *

UNITED STATES PATENT AND TRADEMARK OFFICE

CERTIFICATE OF CORRECTION

PATENT NO. : 5,222,989
DATED : June 29, 1993
INVENTOR(S) : Bohumil Hyca

It is certified that error appears in the above-indentified patent and that said Letters Patent is hereby corrected as shown below:

In column 1, line 56, delete "alternatly" and substitute therefor --alternately--.

In column 3, line 26, delete "The tape feed".

In column 3, line 27, begin a new paragraph and before "device" insert --The tape feed--.

In column 3, line 60, after "way" insert --,--.

Column 4, claim 1, line 29, after "machine" insert --,--.

Signed and Sealed this

Twenty-fourth Day of May, 1994

Bruce Lehman

*Attest:*

BRUCE LEHMAN

*Attesting Officer*

*Commissioner of Patents and Trademarks*